US007308968B2

(12) United States Patent
Denison

(10) Patent No.: US 7,308,968 B2
(45) Date of Patent: Dec. 18, 2007

(54) TRANSPORTABLE RESCUE CONVEYER

(76) Inventor: Orville Douglas Denison, 313 Circle Oak Dr., Monrovia, CA (US) 91016

( * ) Notice: Subject to any disclaimer, the term of this patent is extended or adjusted under 35 U.S.C. 154(b) by 0 days.

(21) Appl. No.: 11/307,453

(22) Filed: Feb. 8, 2006

(65) Prior Publication Data

US 2007/0181363 A1 Aug. 9, 2007

(51) Int. Cl.
*A62B 1/00* (2006.01)

(52) U.S. Cl. ..... 182/42; 198/313

(58) Field of Classification Search ..... 182/42–44, 182/2.5, 69.4; 198/313, 318, 321, 470.1, 198/678.1

See application file for complete search history.

(56) References Cited

U.S. PATENT DOCUMENTS

| | | | | |
|---|---|---|---|---|
| 154,549 | A * | 9/1874 | Holzwarth | 198/318 |
| 307,023 | A * | 10/1884 | Davis | 182/42 |
| 336,414 | A | 5/1886 | Kerr | 182/10 |
| 3,088,542 | A | 5/1963 | Johnson | 182/48 |
| 3,825,107 | A * | 7/1974 | Cary et al. | 198/313 |
| 4,050,542 | A | 9/1977 | Wilson | 182/10 |
| 4,122,917 | A | 10/1978 | Kendrick | 182/144 |
| 4,157,005 | A * | 6/1979 | Orlando et al. | 56/228 |
| 4,531,611 | A | 7/1985 | Curiel | 182/44 |
| 5,020,742 | A | 6/1991 | Haslim | 244/137.2 |
| 5,072,807 | A | 12/1991 | Fujita | 182/42 |
| 5,645,139 | A | 7/1997 | Liou | 182/44 |
| 5,902,089 | A * | 5/1999 | Sinn et al. | 414/398 |
| 6,378,686 | B1 * | 4/2002 | Mayer et al. | 198/314 |
| 6,390,235 | B1 | 5/2002 | Tsay | 182/44 |
| 6,808,057 | B1 * | 10/2004 | Nirmal et al. | 198/312 |

* cited by examiner

*Primary Examiner*—Alvin Chin-Shue
(74) *Attorney, Agent, or Firm*—Louis Ventre, Jr.

(57) ABSTRACT

A transportable conveyer is provided for simultaneous rescue of multiple persons and objects. The conveyer is capable of being stored and transported in a compact folded position. The preferred embodiment is an endless conveyer with three elements: a belt equipped with a plurality of eyes for a hook along the circumferential surface of the belt; a vehicle to transport the belt to a site where rescue is required; and a motor for rotating the belt to raise or lower a load secured to the load affixing means. The belt may be deployed manually or by a powered boom. Hooks, harnesses and bags are used to attach one or more objects of rescue to the belt.

10 Claims, 7 Drawing Sheets

TRANSPORTABLE RESCUE CONVEYER

FIELD OF INVENTION

In the field of emergency rescue and evacuation, a transportable rescue conveyer.

DESCRIPTION OF PRIOR ART

The invention is a transportable conveyer for rescue and escape. It has application to convey people, pets and objects out of harms way in many emergency and non-emergency situations. It has application in fire-fighting, rescues and escapes from houses and buildings, transfers to and from a ship on the water, transfers to and from an off-shore oil platform, rescues from the water, rescues in ravines, rescues from elevated locations, and is suitable for a wide variety of uncategorized rescues and escapes.

The preferred embodiment of the present invention is a transportable endless conveyer. This embodiment can be used for moving rescue workers and supplies up to the elevation of a disaster and then moving people, pets and other objects down to safety where additional rescue workers can administer first-aid and transport the victims to a hospital. When escape is urgent, the preferred embodiment will facilitate saving more people, pets and objects than existing ladder trucks because of the speed and versatility of the conveyer.

The preferred embodiment will improve rescue operations because rescue personnel will be raised by a powered device and not through physical exertion. The device, thus, multiplies the ability of rescue personnel to accomplish their mission and provides the speed necessary to effect more rescues than traditional systems, such as a ladder truck. It further improves rescue operations capability by allowing fire hoses and other equipment to be attached to the belt and raised unattended by a rescue personnel.

It is an object of the present invention to add value and versatility to equipment purchases for fire departments and rescue operations. Value is added by expanding the diversity of emergency situations in which the invention can be used as compared to those situations in which an extendable ladder truck could be used.

Value is added when a trailer-mounted conveyer is used because a single truck tractor can transport multiple conveyers. For example, a single truck tractor can move a trailer-mounted conveyer to the location, drop it off and go back for another unit of the same length or different length. This versatility permits a variety of conveyers to be supplied to a given site or even to multiple sites on any given day.

Value is added by the capability to use a standard semi-truck tractor for conveyer transport because of the ready availability of substitute truck tractors in the event of a breakdown.

Value is added because fewer truck tractors are required than for permanently mounted conveyer trucks, conserving funds for the purchase more conveyers.

Value is added by lower maintenance of engines and associated supplies for those fewer tractor units.

An important feature of the invention is the ability to lower to the ground multiple persons and objects simultaneously. A related important feature is the ability to raise rescue gear on the bottom side of the conveyer, while persons, pets or other objects are being lowered on the topside of the conveyer. Most existing technologies permit lowering or raising one person or object at a time.

The prior art in rescue and escape is greatly limited in the means to save injured and disabled people, pets and other objects. Rescue and escape for these often means being carried on the shoulder or in the arms of a fireman. The present invention permits the device to carry the load when the injured or disabled person, pet or object cannot leave unassisted. The present invention also enables the routine application of oxygen to injured parties on the way to the rescue point.

The prior art in rescue and escape often involves fixed location apparatus that must remain in a deployed state to be capable of being used in a rescue. The present invention is stored and transported in a compact folded position.

Prior art for rescue and escape generally fits three categories, namely devices located on or within a building, a boat or oil platform from which rescue or escape is desired, transportable units for evacuating individuals from buildings by bringing the device to the building, such as the standard fireman's ladder truck; and devices used on helicopters to raise people from ground or water level to the helicopter.

The versatility of the present invention is indicated by the fact that it fits in all three categories. The invention is a transportable unit used for buildings, boats, oil platforms and helicopters. However, it is distinguishable from the prior art by its features.

One of the earliest examples of prior art rescue and escape is U.S. Pat. No. 336,414 to William A. Kerr on May 7, 1886. The '414 patent discloses a transportable telescopic rescue device. The device is extended by gearing and an inclined platform or car is raised and lowered with a rope and pulley system.

The use of a telescopic boom is where the similarity between the '414 invention and one embodiment of the present invention starts and stops. The present invention is different because the '414 patent does not disclose or suggest an endless conveyer. The '414 patent discloses a car raising and lowering device being the only means for moving people or objects. In contrast, the present invention is further distinguished by providing for varied attachment to the conveyer of animals, objects and people to accommodate the diverse rescue situations likely to be encountered in modern day rescue operations.

Another example of the prior art is U.S. Pat. No. 4,531,611 to Yoram Curiel on Jul. 30, 1985. The '611 patent discloses a building evacuation system using an endless conveyer. Platforms are secured to the conveyer for people to stand on while being raised or lowered. The conveyor in the '611 patent is fixed in position at both ends on a building. People enter or exit the platform through a doorway in a tubular member through which the endless conveyor passes. As it passes the doorway, people get onto or off a platform member. A generator provides electricity to power the conveyor and a brake controls the orbital speed.

Unlike the present invention, the invention described in the '611 patent is not a transportable system but rather is fixed in position on a building. The '611 patent does not disclose a conveyer that is stowed in a compact state, but rather is always in a deployed state awaiting activation. The '611 patent discloses a conveyer with a platform being the only means for moving people or objects. In contrast, the present invention provides for varied attachment to the conveyer of animals, objects and people to accommodate the diverse rescue situations likely to be encountered in modern day rescue operations. Finally, the present invention requires no skill or balance on the part of the persons rescued and can safely convey disabled people as well as those capable of self-help.

Another example of the prior art is U.S. Pat. 5,645,139 to David Liou on Jul. 8, 1997. This patent discloses a circulatable ladder that uses a track set, a chain mounted along the track set, a securing device secured to a building for securing thereon the track set and a decelerator mounted on the securing device for slowing down the circulating speed of the circulatable chain. The device is powered by the weight of the individual and can be operated for heavy loading capacity.

The '139 patent is a conveyer-type system and provides high loading capacity, but unlike the present invention, is not a transportable system. The invention disclosed in the '139 patent is a substantial structure to be located on a building. The '139 patent does not disclose a conveyer that is stowed in a compact state, but rather is always in a deployed state awaiting activation. The '139 patent discloses a ladder-like conveyer with platform stands being the only means for moving people or objects. In contrast, the present invention provides for varied attachment to the conveyer of animals, objects and people to accommodate the diverse rescue situations likely to be encountered in modern day rescue operations. Finally, the present invention requires no skill or balance on the part of the users and can safely convey disabled people as well as those capable of self-help.

Another example of prior art is U.S. Pat. No. 5,020,742 to Leonard A. Haslim on Jun. 4, 1991. The '742 patent teaches an airborne rescue system and includes a telescoping boom for extending a winchable line to a rescue victim. The boom telescopes beyond the tip of the helicopter rotor in order to avoid the rotor downwash and to enable the pilot to see the line. When the boom is extended, the rescue line passes through clips, which release the line from the boom when weight is applied to the line forming a straight line between the victim and the winch.

While the invention described in the '742 patent employs a telescopic boom, the boom is not involved in supporting an endless conveyer, but rather is a temporary means to lower a cable outside the downwash from the helicopter rotors. The '742 invention addresses problems experienced by the pilot and the victim to be rescued. These objects are unrelated to the present invention. Further, the '742 patent does not teach the use of varied and multiple attachments to a conveyer, but rather employs the traditional single line winch which is useful for single person rescues. Unlike the present invention, the '742 patent is of little use for routine fire and rescue in buildings on land.

Another example of the prior art is U.S. Pat. No. 4,050,542 to Virgil D. Wilson on Sep. 27, 1977. The '542 patent teaches a telescoping mobile rescue apparatus for rescuing individuals, including injured and incapacitated individuals, from high-rise buildings. An elongated reeved telescoping chute is mounted on a mobile platform and is movable to any angle and extent to reach a desired portion of a building or the like from which rescue is to be effected.

A rescued individual is placed in a bag in a chute that is clipped to the cable section. The chute slides on a pair of cables that flare outwardly from the top of the chute to the bottom of the chute so that an individual sliding down the chute in a bag will be slowed down automatically as the bottom of the chute is reached. The '542 patent purports to enable quick rescue of a number of individuals from high-rise buildings and the like with minimal chance of injury to the individuals.

The '542 disclosure is essentially a transportable slide mechanism. It does not suggest or disclose an endless conveyer. It further does not teach a means to raise rescue personnel and equipment, but rather is a device to permit evacuees to slide down between a pair of cables.

Another example of prior art is U.S. Pat. No. 3,088,542 to C. Elmer Johnson on May 7, 1963. The Johnson '542 patent discloses a hinged or telescoping rescue chute and optional ladder atop the hinged embodiment of the chute for rescuing people from burning buildings. The rescue chute is stowed in segments in an emergency vehicle. The person being rescued slides down within the chute to land on an inflated air mat. A worm gear and rail extend the telescopic embodiment. The embodiment employing hinged tubes requires manual rotation of the tubes to form a single long tube and hydraulic elevation of the chute to the building.

The Johnson '542 disclosure involves telescoping or articulatable elements used to extend the transportable rescue device. However, the Johnson '542 invention is essentially a slide mechanism. The Johnson '542 patent teaches a device to permit evacuees to slide down within an assembled chute. It does not suggest or disclose an endless conveyer as in the present invention. The Johnson '542 disclosure further does not teach a means to raise rescue personnel and equipment, but rather incorporates a traditional ladder where physical exertion of rescue personnel is practiced in using the invention.

Prior art involving boat and oil platform rescue and escape in many cases mirrors that discussed above. Essentially, a rescue ship adjoins another in distress and the people on board the distressed ship are hoisted or lowered to a rescue ship. Slides and moving ladders are known for this application, but are generally fixed to the structure. Slides that are stowed in a compact position do not employ a conveyer as in the present invention. The present invention adds value and versatilities to the prior art in that the conveyer can be used to also load goods and supplies from one ship to another or between the ship and a dock. This duality of use improves reliability of the conveyer used in an emergency because the conveyer is used, and thus tested, more often. The present invention permits equipment failures to be detected and repaired before they occur in an emergency. This duality of use also makes it likelier that more than one conveyer will be available for these uses. Compared to the prior art, the present invention permits a safer transfer capability for disabled persons, pets, and other objects of rescue and escape to a second ship. And finally, the present invention permits the simultaneous transfer of persons and supplies to and from a ship or platform reducing the time required for such transfers.

Accordingly, the present invention will serve to improve the state of the art by providing a transportable conveyer rescue device that is stored and transported in the folded position. It will serve as an improvement in the state of the art in its diversity of rescue situations for which it is useful. It will serve to add value and versatility to equipment purchases for fire departments and rescue operations. It will serve to improve the state of the art by providing a fast, powered lift and descent capability for people, animals and objects, beyond what is possible by having rescue personnel carry individuals down ladders. It will improve fire and rescue in that firemen with fire hoses can be elevated to upper floors of a building structure without exertion from climbing and thus minimizing physical exhaustion of rescue personnel. It will improve rescue capability by allowing fire hoses and gear to be raised unattended by a person. It will permit simultaneous raising of equipment and lowering of rescued individuals. Finally, it will improve rescue capability by allowing more than one person or object at a time to be rescued.

BRIEF SUMMARY OF THE INVENTION

A transportable conveyer is provided for rescue and escape. The conveyer is capable of simultaneous rescue of multiple persons and objects and of being stored and transported in a compact folded position. The preferred embodiment is an endless conveyer with three elements. The first is a belt equipped with a plurality of eyes for hooks along the circumferential surface of the belt to receive a hook. Other load affixing means, such as foot holes in the belt and horizontal bars, are disclosed. The second is a vehicle, (truck, boat or helicopter) to transport the belt to a site where rescue is required. The third a winch or other means for rotating the belt to raise or lower a load secured to the load affixing means. The belt may be deployed by manually lowering the belt to the rescue location, or by employing a hydraulically extendable boom or a winch to extend the belt to one or more objects of rescue. Hooks, harnesses and bags are used to attach one or more objects of rescue to the belt.

DETAILED DESCRIPTION

The invention is a transportable conveyer capable of simultaneous rescue and escape of multiple persons and objects. The preferred embodiment of the invention uses a belt for endless rotation, and, in its most basic form, is composed of three elements: a belt equipped with a plurality of load affixing means along the circumferential surface of the belt; a means for transporting the belt to a site where rescue is required; and a means for rotating the belt with a load secured to the load affixing means. An alternative embodiment of the invention also includes a means for extending the belt to the proximity of one or more objects of rescue. Another embodiment of the invention includes a means for attaching the object of the rescue to the load affixing means.

An alternative embodiment uses a single-way conveyer. Instead of a belt, this embodiment uses a mat in much the same way as the preferred embodiment except that it is either raised or lowered, but not at the same time. As with embodiments using a belt, the mat is equipped with a plurality of load affixing means along the length of the mat; it has a means for transporting the mat to a site where rescue is required; and, it employs a winch for lowering the mat to the location of one or more objects to be rescued and for subsequently raising the mat with one or more of these objects secured to one or more of the load affixing means.

Figure 1:
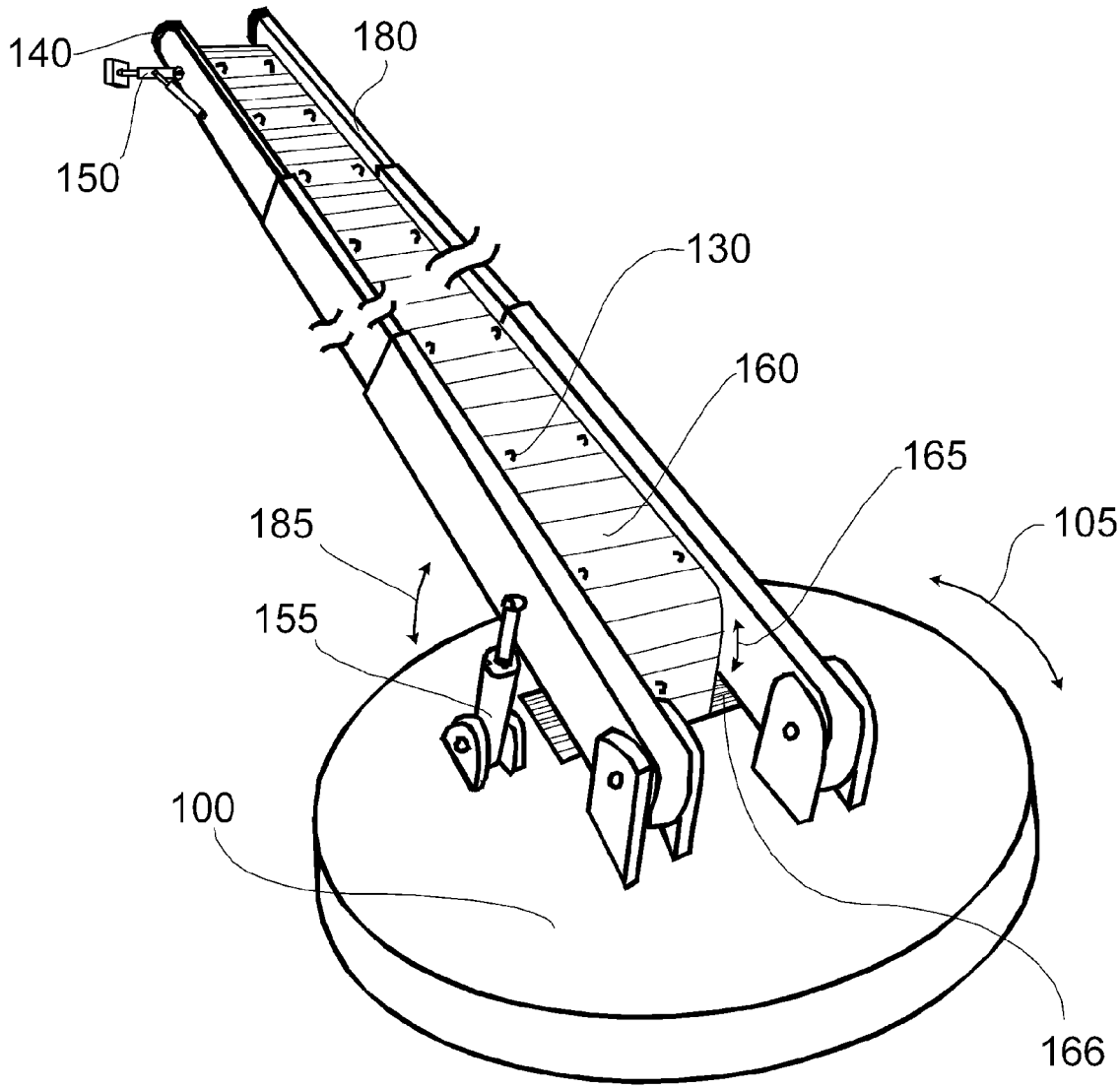
FIG. 1 is a perspective of a telescoping boom embodiment of a transportable endless conveyer.

FIG. 1 illustrates several elements of the preferred embodiment of invention. A hydraulically controlled telescoping conveyer is shown. The base of the conveyer (100) is rotatable to 360 degrees for maximum flexibility in the directions as shown by arrow (105). A boom (180) telescopically extends via hydraulic controls not shown. A hydraulic lift (155), preferably one each side of the boom, raises or lowers the boom to the desired inclination as indicated by the arrow (185). One or more top footpads (150), which are hydraulically or electrically controlled, extend to the wall of a building or rescue location from the topmost boom segment. The top footpads (150) add support to the conveyer, prevent tipping of the unit with heavy loads, and provide space so that the upper moving part of the belt does not come in accidental contact with the wall and so that upcoming rescue gear can be easily removed and used for rescue. Bumper pads (140), typically rubber or composition bumpers, are used for alternative end support when the footpads are not extended. The bumper pads (140) also serve as protective safety caps, keeping objects from wheels or other belt moving components. The belt (160) is initially stored in or under the base unit (100) and is fed through the port (166) as the boom (180) extends to the desired length. Spring-loaded Idler pulleys inside the storage chamber accommodate slack in the belt to permit operation of the conveyer when the telescoping boom is not fully extended. In alternative embodiments, the belt is in contact with the full length of the folded conveyer at all times so there is no separate tension take-up chamber or idler pulleys required.

Figure 2:
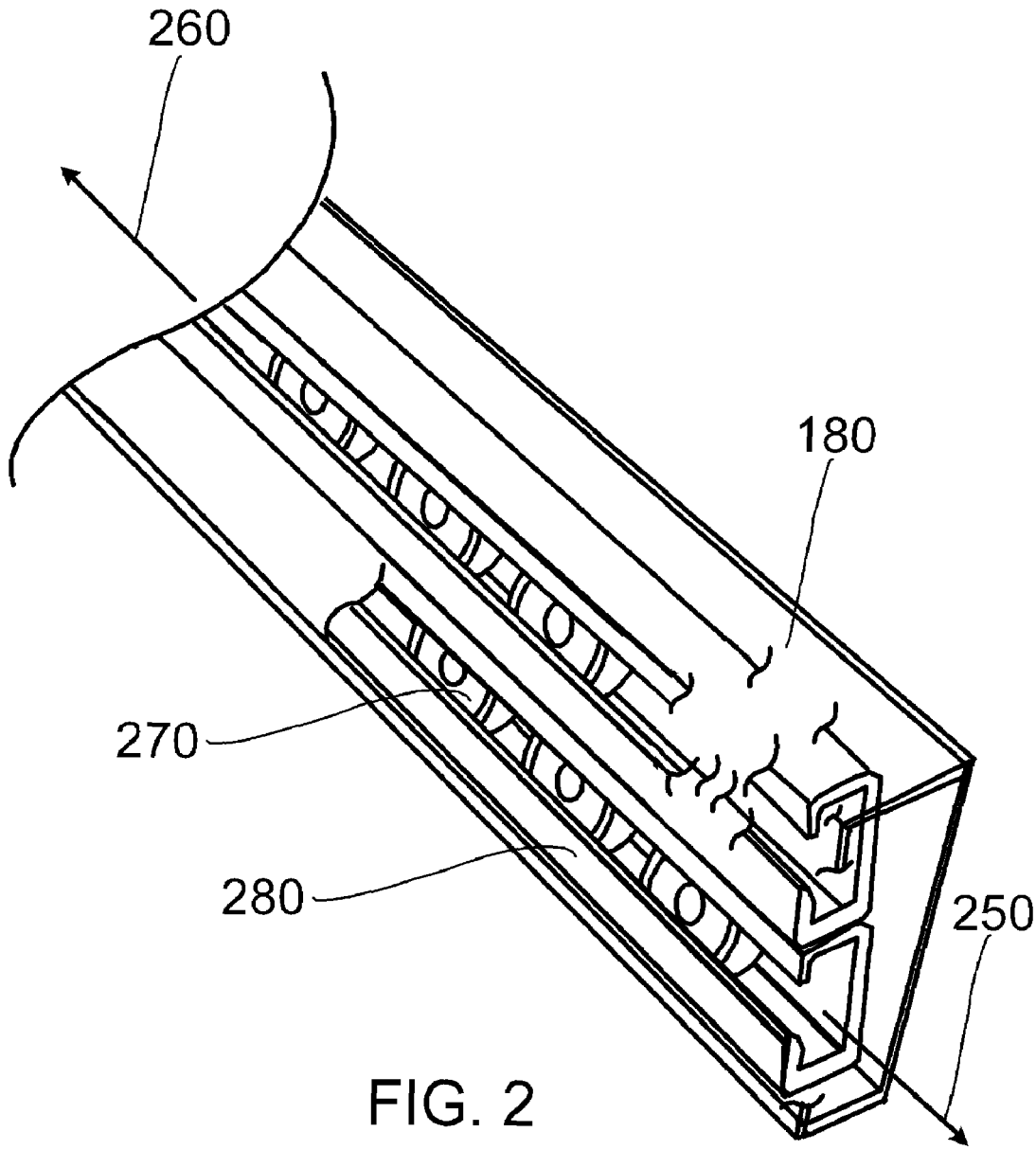
FIG. 2 is a cut-away view of wheels and bearings situated in channels in a telescoping boom and used to facilitate rotation the belt along the boom.
Figure 5:
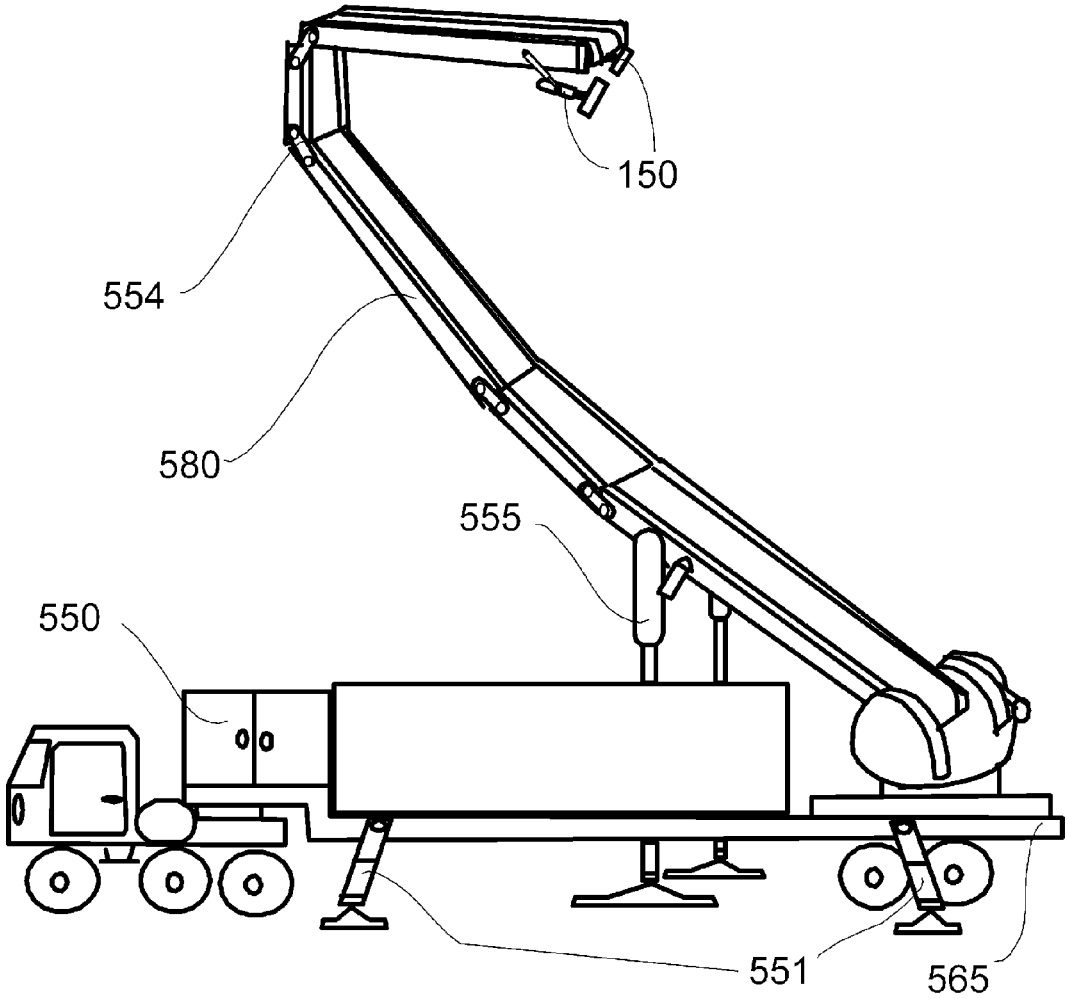
FIG. 5 is a perspective of a linear folding boom partly through the unfolding process.
Figure 6:
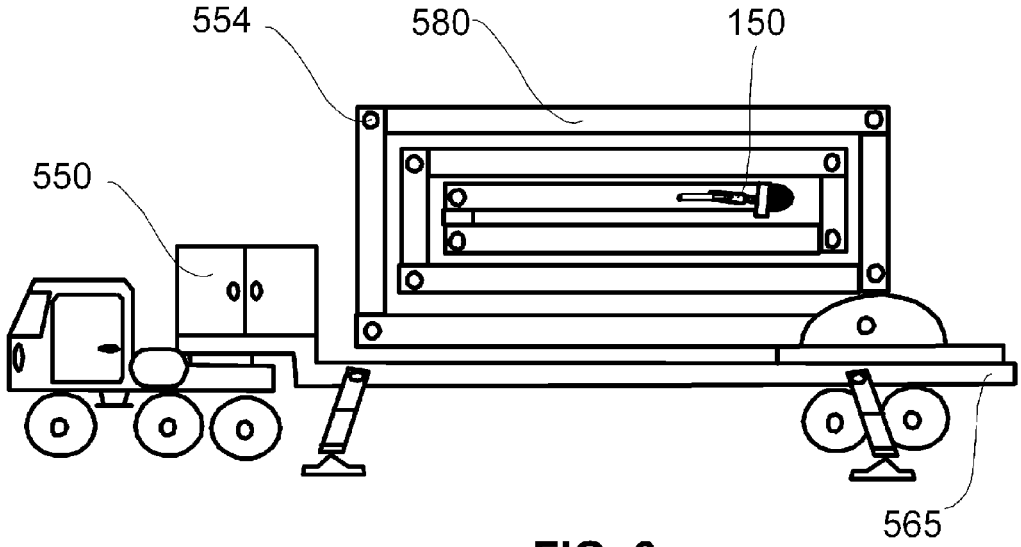
FIG. 6 is a side view of linear unfolding boom in a folded position as mounted on a trailer.

In the embodiment shown in FIG. 1, the load affixing means (130) are eyes that will accept a hook, a rope or other load attaching means. Each eye (130) is a metal of semicircular cross-section wherein the belt serves to join the ends of the metal to form a closed ring capable of receiving a hook and sustaining a load therefrom. An assembly of the rollers, which are attached to the sides of the belt to facilitate confined movement of the belt, is shown in FIG. 2. The rollers (270) are confined within channels (280) inside each side beam of the boom (180). The rollers (270) in one channel move in one direction along the length of the channel, e.g. as shown by an arrow (250) and the rollers in the other channel move in the opposite direction as the belt is rotated, e.g. as shown by another arrow (260). Transportable conveyers utilize a plurality of stability support legs (551) as shown in FIG. 5 and FIG. 6 when the application so requires.

Figure 8:
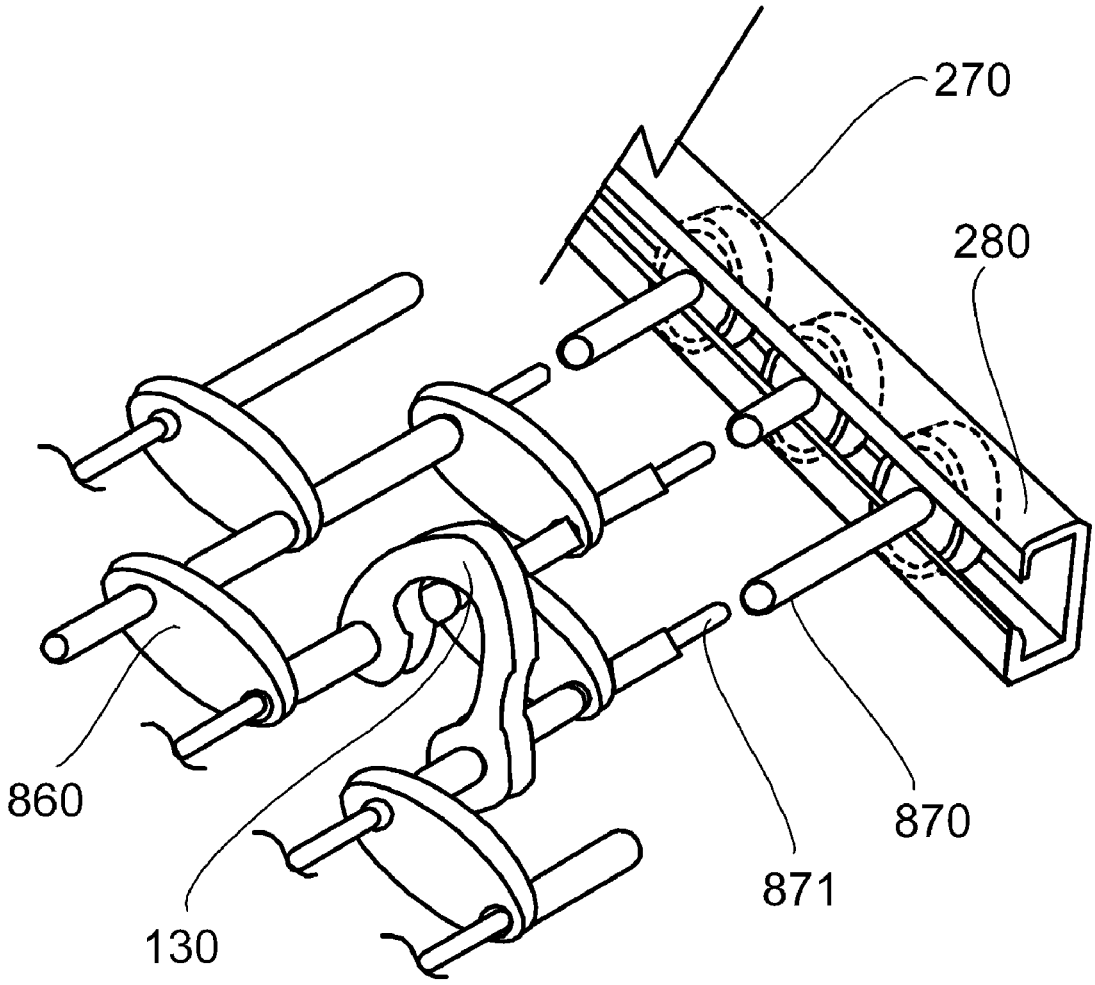
FIG. 8 is an exploded perspective of a metal links belt.

In the preferred embodiment, the belt runs in a continuous loop and is constructed of any durable material preferably, those materials that would be sufficiently flexible to function as a rotating belt in the presence of heat, smoke, water, and other emergency site debris. Typical examples of embodiments utilize a belt of metal links, sturdy reinforced fabrics, plastics or metal mesh. Titanium, stainless steel, or any material suitable to function in the rescue situations would be appropriate belt material. FIG. 8 shows an embodiment of a metal links belt with a load affixing means (130), a joining bracket (860) separated by one or more sleeves or spacers (870) and joined together with rods (871) spanning the belt.

The belt is typically configured to have a circumference that is much longer than the width of the belt.

In the preferred embodiment the belt will have a strength suitable to lift thousands of pounds of weight without significant deformation. Such strength is desirable to afford capability to lift or lower multiple persons, rescue gear, and other objects requiring rescue.

In the preferred embodiment, the belt is equipped with a plurality of load affixing means. Such load affixing means (130) is an attachment to the belt extending from the surface of the belt and being capable of receiving a hook and sustaining a load from the hook. Typical examples of this attachment are an eye for a hook or to serve as a tie point for a rope, and a metal ring. In the preferred embodiment as shown in FIG. 1, there are two parallel rows of load affixing means (130) along the outer circumference of the deployed belt. Horizontal pairs of the load affixing means may be used to attach bars or ladder type rungs to form a vertical ladder along the length of a deployed belt. Ladder rungs are either manually attached as required, or are permanently attached to serve a context similar to a fire truck's hook and ladder. Ladder rungs are used, for example, to hold onto or attach objects to the rung with locking type hooks while being lowered or raised. The power to lift or lower the person or object would normally be provided by the belt rotation power supply.

In another embodiment, the load affixing means is a simple foot and hand hole in the belt to accommodate a person stepping in and grabbing hold of the belt around the hole and being hoisted or lowered to safety. Thus, the load affixing means is the material of the belt formed with a plurality of holes such that when a load is placed in said hole and resting on the material of the belt around a portion of the circumference of said hole, the belt remains capable of sustaining the load.

Figure 4:
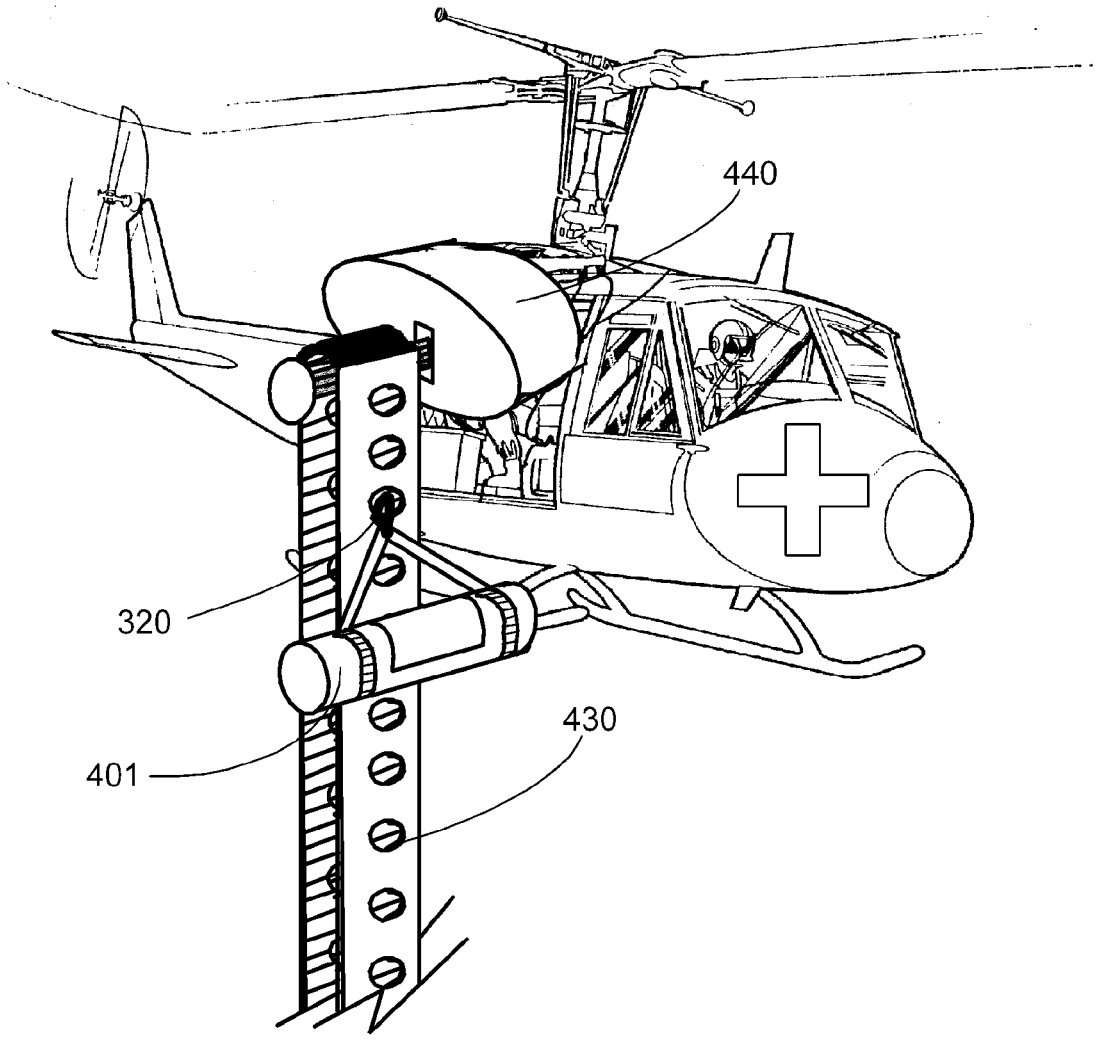
FIG. 4 is a perspective of a helicopter and winch embodiment of the invention.

In another embodiment, the load affixing means is a hole with a reinforcing bar through the center of the hole (430) as shown in FIG. 4. Thus, a bar spans each hole and reinforces the load sustaining potential of the belt.

In another embodiment, the load affixing means are incorporated into the belt surface of metal links or wire mesh as discussed above relative to FIG. 8.

In other embodiments, the load affixing means is a combination of one or more foot and hand holes, eyes for hooks, wire mesh, metal links and holes with reinforcing bars.

The means for transporting the belt to a site where rescue is required is essentially any vehicle, such as a truck, a trailer, a boat or a helicopter. A truck is typically an emergency vehicle similar to a fire truck that might otherwise be equipped with a hook and ladder, but in the preferred embodiment of the invention is instead equipped with a telescopic belt and the other elements of the invention. In another embodiment, the means for transporting is a trailer. A trailer can be towed to the rescue site by a truck tractor or other vehicle. A low bed trailer as shown in FIG. 5 and FIG. 6 is suitable when transporting larger transportable conveyers. A trailer would typically be a self-contained operational conveyer with its own power supply for the electrical and hydraulic system.

In another embodiment, the invention is used on a boat to transfer injured from one boat to another boat. In another embodiment, the invention is used on a helicopter, for example for individuals requiring emergency evacuation from a flooded area or at sea. FIG. 4 depicts an emergency service helicopter as the means for transporting. A motor (440) is used to rotate the belt having holes with a reinforcing bar (430) as load affixing means. A protective bag (401) with an internal oxygen supply is being lifted as would be suitable for smoke filled or noxious environments or when the person being rescued requires oxygen treatment. For this application, the protective bag has holes in the bottom of the bag to allow any water to drain out. The bag (401) is attached using a locking hook (320). The operator rotates the load into the helicopter cabin when it reaches the top.

The means for rotating the belt with a load secured to the load affixing means is essentially a motor or winch, which may be powered by any source commonly available, such as hydraulic or electrical power. In the operation of the preferred embodiment of the invention, belt rotation begins once the boom has been extended. Once belt rotation is initiated, the belt is in continuous motion simultaneously lifting and/or lowering one or more people, animals or other objects in a rescue situation. An example of simultaneous lifting and lowering is the raising of rescue gear on the bottom side of the conveyer, while persons, pets or other objects are lowered on the topside of the conveyer. An example of simultaneously lifting or lowering is loading more than one person, animal or other object on one side of the conveyer for transport to the rescue point. In alternative embodiments, the means for rotating the belt includes controls for varying and changing the direction of belt travel and the rate of travel of the belt by one or more hard-wired units, preferably by hard-wired panel at the top and bottom of the conveyer, and by a wireless and elsewhere by a wireless control pad. Such controls provide the bi-directional capability to rapidly traverse the conveyer with equipment and people. The load referred to is either the rescuer and the rescuer's equipment, or a person or persons requiring rescue, or animals requiring rescue, or any object desired to be rescued, or any combination of them.

In an alternative embodiment, the belt is simply manually deployed by dropping the belt to a lower position, as when the belt is deployed from a helicopter, or over the edge of a bridge.

The preferred embodiment includes a means for extending the belt to the proximity of one or more objects of rescue, that is, a telescoping boom. Such a telescoping boom may be other than a dual boom system as shown in FIG. 1. Reference herein to boom is generic and is intended to reference and include the use of more than one beam or tube acting together as a unit. An alternative embodiment provides for a single telescoping beam being a plurality of tubes nested inside the largest tube. All shapes of telescoping booms are within the scope of the invention, such as those with round, tri-angular, square, rectangular or hexagonal, or combination of these cross sectional shapes. Booms powered by hydraulically or by electric motors are within the definition of a telescoping boom as used herein.

Alternative embodiments employ a means for extending the belt that is a linearly unfolding boom system. Two examples of a linearly unfolding boom are shown in FIG. 5 and FIG. 6 wherein the boom segments (580 and 580) articulate in respect to each other and unfold to a straightened locked position in the manner of a fist unfolding to an outstretched hand. In this embodiment, folding and unfolding the boom is controlled by hydraulics. A cabinet (550) housing a hydraulic control unit and rescue gear is at the front of the trailer (565). Individual hydraulic controls (554) between the boom segments are centrally activated to open and close the boom.

In the preferred embodiment, at least one hydraulic lifter (555) (two are shown in FIG. 5) raises and lowers the boom to the required angle. For the hydraulic lifter (555) in the preferred embodiment of the means for extending, additional lifting potential and conveyer reach is obtained with the use of at least one, and preferably two, compound hydraulic lifters on the boom as shown in FIG. 5. Each compound lifter adds potential to accommodate heavy weight and extended reach offered by longer booms.

Each compound lifter performs two independent extensions. In its stored position the compound lifter rests against a beam of the boom. For deployment, a worm gear or hydraulic unit rotates each compound lifter to a position generally perpendicular to the ground. The foot on each compound lifter is then lowered to the ground. An alternative embodiment extends each foot to either the trailer or the ground, preferentially in a perpendicular orientation.

The purpose and design of the foot is in the manner of outriggers commonly used in the industry. As is typical, the foot swivels to meet the terrain angle. As in common practice, when the ground is soft or to prevent damage to the surface, a steel plate or boards are used as a force spreading means under the foot. In a second operation after the foot is securely positioned on the trailer or ground, the hydraulic lifter then raises the boom to the desired inclination. In other embodiments the hydraulic lifter is only connected to the trailer or to the ground. An alternative embodiment uses electrical motors instead of hydraulics.

Outriggers, or stability support legs (551), on the trailer are well known in the industry, provide a greater load and reach potential for the boom and assist in preventing tipping of the conveyer with heavy loads. The preferred embodiment of the invention contemplates the availability of a plurality of support legs to accommodate a variety of rescue sites. An alternative embodiment uses electrical motors instead of hydraulics.

Figure 7:
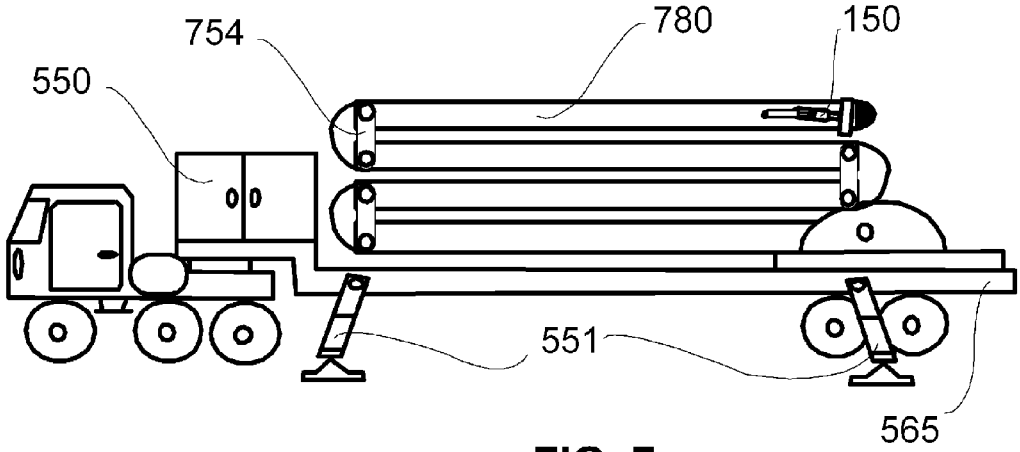
FIG. 7 is a side view of a trailer mounted accordion-type folding boom in the stored position.

In another embodiment, a means for extending the belt is a boom that unfolds similarly to an accordion or folded map. FIG. 7 shows this boom mounted on a trailer (565) wherein the boom (780) is shown in the stored position. Hydraulic controls (754) between the boom segments open and close the boom. A cabinet (550) housing a hydraulic control unit and rescue gear is at the front of the trailer (565). An alternative embodiment uses electrical motors instead of hydraulics.

In another embodiment, a means for extending the belt is a winch system, pulling or extending a boom into a fully deployed position with wire rope and pulleys. Such embodiments would be powered by means well known in the art, such as electric motors or hydraulics or a combination thereof.

Alternative embodiments of the invention also include a means for attaching the object of the rescue to the load affixing means on the belt. Typical types of means for attaching include foot securing, wrist securing, waist securing, torso securing, and bag securing. These types of means for attaching often include the use of ropes, straps, gear hangers or hooks and harnesses made of various materials including but not limited to metals, stainless steel fabrics, nylon and puncture resistant fabrics, carbon fiber reinforced textiles, and other fire retardant materials with sufficient strength to transport the humans, pets or objects up or down without tearing or rupturing. Ropes and straps have a universal appeal in their simplicity and ubiquitous availability. Hooks, typically those with locking devices to prevent accidental disengagement, are well known and also commonly available for fast attachment of ropes, straps, harnesses and bags.

Figure 3:
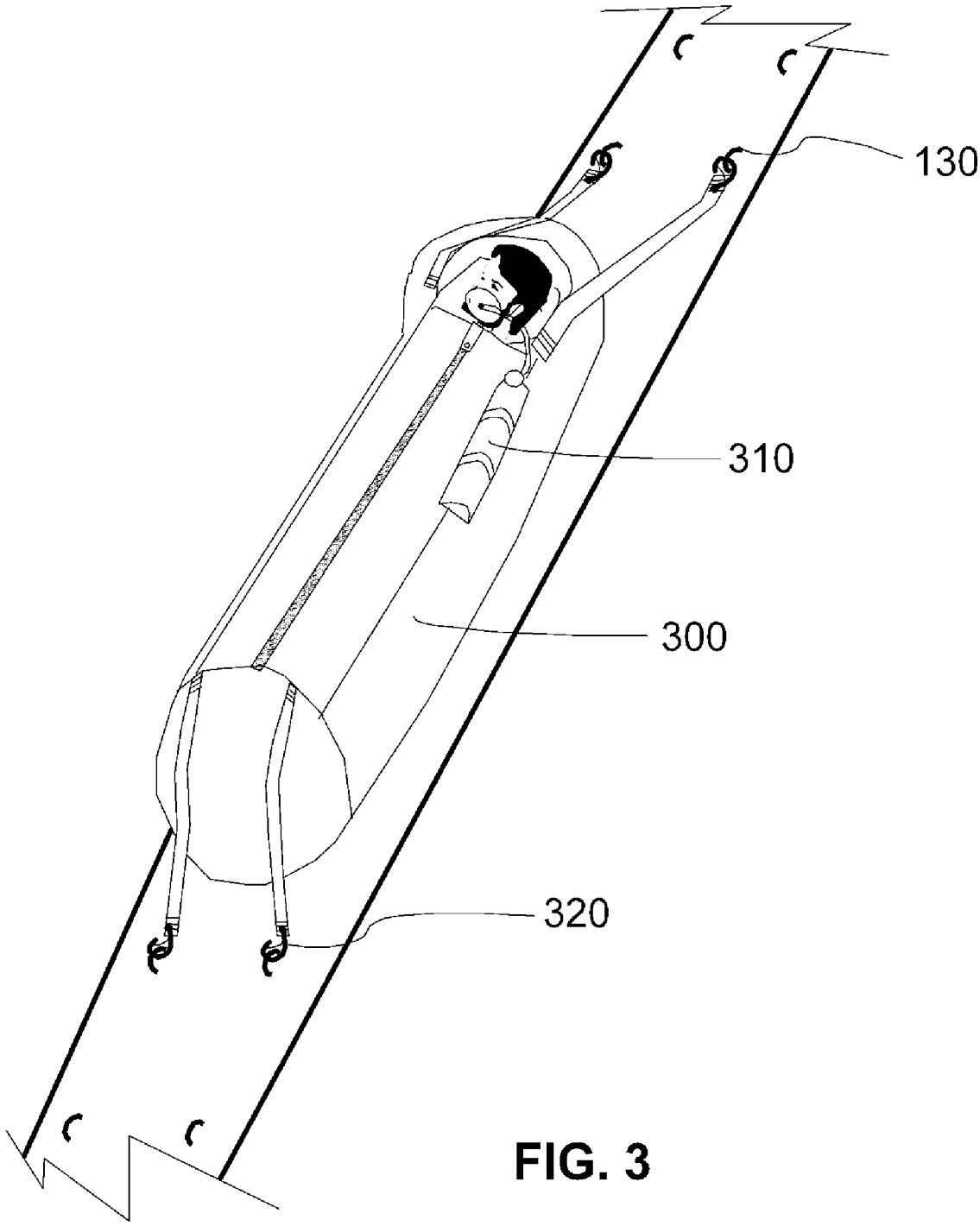
FIG. 3 is perspective of a rescued person conveyed in a bag attached to the belt.

An oxygen tank (310) is shown with the bag securing type in FIG. 3, and the invention contemplates that any of the types of means for attaching may be supplemented with portable oxygen tanks to assist in treating the injured. The bag securing type includes bags that totally or partially enclose the rescued person or other object. A protective bag for water rescues typically includes holes in the bottom of the bag to drain out any water that enters the bag.

The foot securing type comprises a bar spanning at least two of the load affixing means such that the bar forms a substantially horizontal ladder rung on the belt to support a person standing thereon and serve as another means for attaching rescued objects to the belt. This type would be common for firefighter applications where the invention is used for both raising a firefighter and his equipment, as well as lowering those being rescued.

The torso securing type includes stretchers and harnesses. Stretchers have hooks and restraining straps to attach to the belt and hold the object of the rescue. This type of means for attaching includes a stretcher with a protective cover to securely hold a person on the stretcher during movement on the conveyer. Such a protective cover is utilized to enclose all or only a section of the stretcher, for example a section rising from the foot area on the stretcher to assure that the person would not slide out or off of the stretcher if secured in a vertical position along the belt length.

Harnesses, typically made of leather or nylon fabric and secured with a buckle or friction holder, are well known and available to the rescue community from established suppliers. Such harnesses are used to secure unconscious persons wrists and then hooked to the load affixing means on the belt to raise the person by their arms. A torso harness, similar to that used in sky diving is donned by a person requiring rescue and hooked to the load affixing means on the belt to raise the person in a more comfortable position. Finally, the means for attaching includes bags of various sizes, which are designed for small, average, large and heavy people, are used for holding all manner of objects to be rescued, including injured and unconscious people, babies and pets. Some such are padded so that contact with the belt does not cause additional injury to victims or rescue workers. The bag (300), shown in FIG. 3, includes 4 straps and hooks (130) and is equipped with an external oxygen system (310) to deliver emergency treatment even before the person being rescued is delivered to safety.

The means for attaching permit attachment in all directions from horizontal or to vertical so as to accommodate an injured party and minimize any further harm. The invention contemplates use of all these means for attaching.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

What is claimed is:

1. A transportable endless conveyer capable of simultaneous rescue and escape of multiple persons and objects comprising, (a) a rotatable base having at least a side wall and a top wall defining a storage space within the base;

(b) dual telescoping booms pivotally connected to the top wall of the rotatable base and located a fixed distance apart and operably connected together to extend and retract in unison from the rotatable base;

(c) a belt equipped with a plurality of load affixing means along the circumferential surface of the belt, said belt spanning the fixed distance apart between the dual telescoping booms and operably connected to the dual telescoping booms to extend and retract from the storage space in unison with the telescoping booms;

(d) a means for transporting the belt to a site where rescue is required; and, (e) a means for rotating the belt with a load secured to the load affixing means, wherein each load affixing means comprises an eye attachment to the belt extending from the surface of the belt and being capable of receiving a hook and sustaining a load therefrom.

2. The transportable endless conveyer of claim 1 wherein the eye comprises a metal of semicircular cross-section wherein the belt serves to join the ends of the metal to form a closed ring capable of receiving a hook and sustaining a load therefrom.

3. The transportable endless conveyer of claim 1 wherein the means for transporting the belt to a site is selected from a group consisting of a truck, a trailer, a boat, and a helicopter.

4. The transportable endless conveyer of claim 1 further comprising one or more footpads at the ends of the dual telescoping booms that are furthest from the rotatable base.

5. The transportable endless conveyer of claim 1 further comprising one or more bumper pads at the ends of the dual telescoping booms that are furthest from the rotatable base.

6. The transportable endless conveyer of claim 1 further comprising a means for attaching an object of a rescue to the load affixing means.

7. The transportable endless conveyer of claim 6 wherein the means for attaching is a type selected from a group consisting of foot securing, wrist securing, waist securing, torso securing and bag securing.

8. The transportable endless conveyer of claim 6 wherein the means for attaching is equipped with an oxygen tank and mask suitable for use by an injured person.

9. The transportable endless conveyer of claim 1 wherein the means for rotating the belt with a load secured to the attachment means is selected from a group consisting of a motor and a winch.

10. The transportable endless conveyer of claim 9 wherein the means for rotating the belt with a load secured to the attachment means is controllable at both ends of the boom by hard-wired panel and elsewhere by a wireless control pad.

* * * * *